US008422712B2

(12) United States Patent
Danley

(10) Patent No.: US 8,422,712 B2
(45) Date of Patent: Apr. 16, 2013

(54) HORN-LOADED ACOUSTIC SOURCE WITH CUSTOM AMPLITUDE DISTRIBUTION

(76) Inventor: Thomas J. Danley, Highland Park, IL (US)

( * ) Notice: Subject to any disclaimer, the term of this patent is extended or adjusted under 35 U.S.C. 154(b) by 588 days.

(21) Appl. No.: 12/456,541

(22) Filed: Jun. 18, 2009

(65) Prior Publication Data

US 2009/0323996 A1 Dec. 31, 2009

Related U.S. Application Data

(60) Provisional application No. 61/132,376, filed on Jun. 18, 2008.

(51) Int. Cl.
*H04R 25/00* (2006.01)

(52) U.S. Cl.
USPC ..... 381/340; 381/339; 381/341

(58) Field of Classification Search ..... 381/337, 381/339, 340, 341, 342, 343, 160, 182; 181/144, 181/181/152, 159, 177, 183, 185, 187, 199, 181/176, 191, 192, 195
See application file for complete search history.

(56) References Cited

U.S. PATENT DOCUMENTS

| | | | | |
|---|---|---|---|---|
| 2,638,510 | A * | 5/1953 | Brami | 381/341 |
| 4,040,503 | A * | 8/1977 | Hino et al. | 181/192 |
| 5,526,456 | A * | 6/1996 | Heinz | 381/340 |
| 6,064,745 | A * | 5/2000 | Avera | 381/343 |
| 6,581,719 | B2 * | 6/2003 | Adamson | 181/182 |
| 7,278,513 | B2 * | 10/2007 | Brawley, Jr. | 181/176 |

* cited by examiner

*Primary Examiner* — Huyen D Le
(74) *Attorney, Agent, or Firm* — Olson & Cepuritis, Ltd.

(57) ABSTRACT

A sound reproduction system is disclosed in which at least one driver is provided, along with a horn member in acoustic loading relationship to the driver. The horn member defines an internal passageway having a first end and a second open end, with the driver at the first end, producing a driver soundwave having an initial central axis and an initial amplitude distribution. A plurality of vanes are disposed in the internal passageway, at different angles from the central axis to deflect respective portions of the driver soundwave so as to alter the initial amplitude distribution.

2 Claims, 22 Drawing Sheets

RADIATION PATTERN FOR SAME CONICAL HORN WITH SHADED AMPLITUDE LENS. ANGLE TENDS TO BE MORE LIKE BETWEEN THE TWO INNER CELLS IF MADE LIKE THIS

HORN-LOADED ACOUSTIC SOURCE WITH CUSTOM AMPLITUDE DISTRIBUTION

CROSS-REFERENCE TO RELATED APPLICATIONS

This application claims the benefit of U.S. Provisional Application No. 61/132,376, filed Jun. 18, 2008, which is incorporated herein by reference.

FIELD OF THE INVENTION

The present invention relates to sound reproduction systems in which one or more drivers, mutually coupled to a horn member, have their amplitude distribution altered by vanes disposed in the interior of the horn member.

DESCRIPTION OF THE RELATED ART

Originally, the art of horn loading of point source drivers was done to increase the electroacoustic efficiency of the drivers. Various techniques were employed early on to make the most of limited amplifier power and relatively low power handling capabilities of available drivers. Early efforts were centered around obtaining the greatest sound level possible. Horn loaded speakers, sometimes referred to simply as "horns" or "warning systems" of this early era were generally designed to have a specific expansion rate throughout, and typically were made to have a defined shape such as that of a simple cone as well as curved wall flares having shapes corresponding to exponential or hyperbolic curves. Typically, these designs were aimed at giving the best low-frequency performance.

Complementary horn/driver systems were developed for different frequency ranges to optimize the ability of a horn to confine the sound wave in a practical manner. The design of relatively low frequency horns encountered challenging problems because of the mass and acoustic size required, and because the ability of a horn to confine the sound to a given angle diminishes below some frequency defined by the wavelength being produced for horns having a practical wall angle and dimension. For practical horns, a frequency inevitably arises where, due to practical dimensional considerations, the horn loses the ability to control the radiation angle of the soundwave being guided by the enclosure.

As noted above, one practical challenge faced by loudspeaker systems of all types is the ability to deliver a minimum desired sound pressure level to the listener's environment. Over the years, certain fundamental types of loudspeaker systems have been recognized for their inherent ability to deliver sound pressure levels. The two most popular types are those employing point source drivers (cones, domes, horns, multicellular panels, etc.). and line source drivers (e.g. ribbon drivers and elongated planar drivers). With point source drivers, sound is conceptualized as emanating from a single point, expanding in all directions, i.e. "spherically" (e.g. vertically, floor to ceiling and horizontally, side to side).

In contrast, a line source radiates sound in a cylindrical pattern. Sound travels outward from the driver in the shape of an expanding cylinder, bounded at its ends by flat end planes, and not as an expanding sphere, as in the case of point sources. This confined soundwave pattern of a line source is inherently more efficient that that of a point source, since the expanding spherical sound energy of a point source is confined into the shape of an expanding cylinder, so as to "focus" or concentrate the same energy into a spatial region of reduced size. Theoretically, line source systems are twice as efficient as point source systems.

Line sources may be characterized as a type of acoustic source which is acoustically large in one dimension (their length) but acoustically small in the other direction (cross-sectional dimension). Attempts have been made, for example, to emulate a line source by a linear arrangement of discrete line sources. Despite some interesting results, improved systems are still being sought. One problem with such arrangements, for example, is the undesirable interaction of one point source with another that inevitably arises due to propagation effects arising in a practical system.

Attempts have been made over the years to improve speaker systems used to deliver sound to large audiences. Outdoor locations have proved particularly difficult for sound engineers, with nonlinearities in frequency response and amplitude distribution posing the greatest challenges.

SUMMARY OF THE INVENTION

The present invention provides a novel and improved sound reproduction system in which the physical soundwave paths from a driver to the system output is made to be different at different locations, so as to shape the amplitude distribution of the system soundwave output.

In one embodiment, this is accomplished with the use of dividers or vanes within a horn system. The positions of the vanes and their interaction with the soundwave alter the normal amplitude distribution that a similar horn system without vanes would produce. By introducing zones of reduced pressure rather than a physical boundary, more directivity can be achieved than would otherwise be expected.

One embodiment of a sound reproduction system according to principles of the present invention includes a system for reproducing sound, comprising at least one driver and a horn member in acoustic loading relationship to the driver. The horn member defines an internal passageway having a first end and a second open end, with the at least one driver at the first end, producing a driver soundwave having an initial central axis and an initial amplitude distribution. A plurality of vanes are disposed in the internal passageway, at different angles from the central axis and deflect respective portions of the driver soundwave so as to alter the initial amplitude distribution.

DESCRIPTION OF THE PREFERRED EMBODIMENTS

Figure 1:
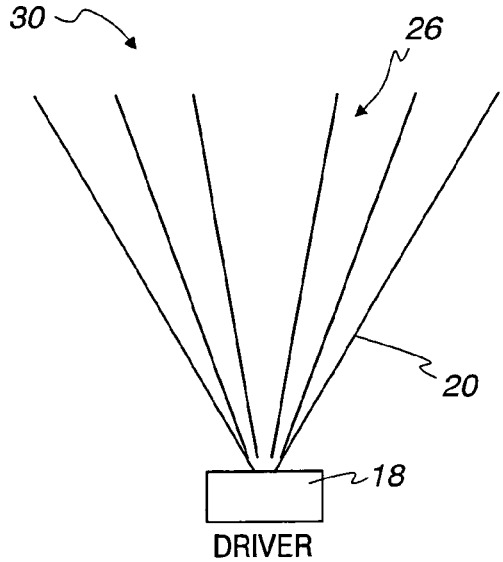
FIG. 1 is a diagrammatic representation of a first embodiment of a sound reproduction system illustrating certain aspects of the present invention.

The invention disclosed herein is, of course, susceptible of embodiment in many different forms. Shown in the drawings and described herein below in detail are the preferred embodiments of the invention. It is to be understood, however, that the present disclosure is an exemplification of the principles of the invention and does not limit the invention to the illustrated embodiments.

For ease of description, sound reproduction systems embodying the present invention are described herein below in their usual assembled position as shown in the accompanying drawings and terms such as front, rear, upper, lower, horizontal, longitudinal, etc., may be used herein with reference to this usual position. However, the sound reproduction systems may be manufactured, transported, sold, or used in orientations other than that described and shown herein.

Figure 16:
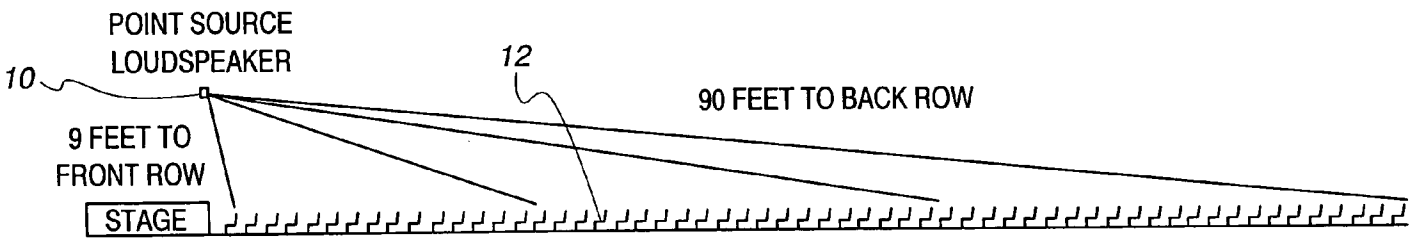
Fig. 16 (Prior Art)
FIG. 16 is a schematic diagram of an outdoor location with a flying sound reproduction system.

The present invention addresses problems that sound engineers have had to deal with time and again. With reference to FIG. 16, a typical outdoor application for a sound reinforcement speaker 10 is shown. Speaker 10 operates as a point source suspended above an audience seating area 12. Three path lengths of the speaker soundwave output are shown. It is clear that, due to the inverse square law that governs operation of point sources, that the delivered soundwave is louder in the front rows than the back rows. As will be seen, the present invention overcomes this falling sound pressure level with increasing distance.

"Line source" speaker systems have become popular in sound reinforcement applications. While these types of systems tend to be vertical rows of drivers (see, for example, U.S. Pat. No. 6,834,113) and not actually a homogenous source, systems are available that do function reasonably well as a true line source. One example of a real line source, embodied as a full length ribbon driver, is the Radia Pro 1.9 ribbon line array, commercially available from BG Corp., 3535 Arrowhead Dr., Carson City, Nev. 89706 USA.

Theoretically, when a planar acoustic source, such as a vertical ribbon speaker, is many wavelengths long, the shape and acoustic size confine the radiation to a very small angle in the vertical plane. If the line source is large enough acoustically, what is radiated by the "line source" is a cylindrical shaped wavefront (spreading in one plane only) instead of a spherical one. One advantage of this is that, when one confines the radiation angle to zero degrees or "no spreading" in one axis, then the sound pressure level fall-off with respect to distance, is theoretically half that of the point source. This means, for example, that instead of the level falling 6 dB per doubling of distance, it only falls 3 dB.

In commercial sound engineering applications, this advantage in theory means that the back row of the audience will have a sound level that is greater than they would have experienced from a point source system having the same "front row" sound pressure level. In this use (see FIG. 16), the line source replacing the point source would be oriented vertically (i.e. becoming a vertical line source), confining the outputted soundwave pattern in a vertical plane.

One downside of the line source system is that the effect depends entirely on the "acoustic size" of the source (i.e. the driver). In practice, what are called "line sources" typically act like point sources at low frequencies as they are acoustically too small, act line a line source only part of the time in the mid range of the output frequency regime, while at high frequencies, the individual sources act like individual point sources (with attendant overlapping interference regions) instead of combining into an acoustic line source.

One finds that this type of "line source" system has a highly variable spectrum or frequency response as a function of distance from the system. As a result, the distribution of high, mid and low frequencies changes, depending on how far away from the source the listener is located, and at any given point in the audience area, a high resolution measurement will reveal peaks and dips related to the line length. This result arises because a given length line array exhibits, in effect, a variable acoustic length, the dimensions of which are fixed while the wavelength varies in size.

Wavelength can be found by taking the speed of sound, divided by the frequency. For example, 1132 Feet per second/100 Hz=a wavelength of 11.32 feet, or 135.8 inches, while the wavelength at 10 Khz is then 1.35 inches etc. The variability of the line sources angular radiation as a function of frequency has been observed. To compensate for this problem, line source systems are generally curved physically or in time, electronically, to try to partially emulate a point source, reducing the frequency dependent line effect. In the case of an acoustically tall source, it's physical size produces a variable vertical radiation pattern, narrowing as the frequency climbs, an effect that is caused by the source having a length of increasing number of wavelengths in dimension.

Many systems erroneously described as "line array" systems in use have the additional problem in that they are a large number of individual sources which are acoustically too far apart to combine into a homogonous source. These and other acoustic problems related to sources that attempt to emulate true line sources is why customary frequency response curves used throughout the industry for other types of devices are oftentimes no longer used for these types of systems.

Referring again to FIG. 16 a speaker 10 is flown in the air in front of an audience 12 seated in an outdoor venue. Since speaker 10 operates as a point source, the sound pressure level of its output soundwave falls off by 6 dB each time the distance to the source is doubled. As a result, the rear seats would receive considerably less (about 1/100) than the sound level delivered to the front rows. Assuming, for example, the speaker 10 operates as a constant directivity point source and unlike the line array, its response or sound spectrum does not depend on or change significantly with distance from the source, only the sound level changes with distance. If the speaker were replaced by a line source whose vertical directivity changes a great deal throughout the "full range of music, the amplitude changes less with distance but now the spectrum or the speaker frequency response changes also with distance.

Attempts have been made in the past, but before the popularity of line arrays, to try to deal with the inverse square law. One method employed the use of a cluster of point source horns, using a "long throw" (physically large, narrow angle coverage) horn pointed to the last row, with a smaller, wider coverage angle speaker below and so on. While conceptually this "long/medium/short" throw horn approach appeared promising, problems arose because actual practical sources do not actually add together coherently, but rather interfere with each other, so much so, that the development of the line source essentially made this approach obsolete. At this point in time, little was known about what was needed to make drivers covering different ranges combine coherently. These earlier solutions resulted in individual horns that, at best, could only cover a narrow frequency range.

By way of a different approach, the present invention alters the directivity and amplitude distribution of a horn which allows shading, compensation or selective favoring of the amplitude, in a particular direction. One embodiment of the present invention employs a shaded amplitude lens to be added in combination with a conventional horn system, including horn systems driven by point source or line source drivers. As a result, a single horn can be produced with an output or radiated sound pattern that performs like previous assemblies comprised of "perfect" long, medium and short throw horn sections. In contrast, with the present invention, the system can include but a single horn whose output is shaded or skewed so as to favorably alter the amplitude distribution of the system. Systems according to principles of the present invention can be employed alone, or a one or more stages of a larger system.

When a horn mouth is acoustically large enough relative to the wavelength being produced, the horn wall angle defines the edge (−6 dB point) of the horn's radiation pattern. One explanation for this "confining effect" is found in a paper by Don Keele entitled "What's So Sacred About Exponential Horns?", 51st AES convention preprint, page 1038. In this paper, a formula is given for the relationship between the acoustic dimension and the wall angle, which governs directivity at a given point in a horn system.

A horn with straight sides has radiation patterns that are essentially constant down to the frequency where the mouth dimension and angle control intercept point is reached. With a practical horn system, there is a solid physical boundary which confines sound. According to one embodiment of the present invention referred to as a "shaded amplitude lens," dividers or vanes are employed within the horn enclosure. The positions of the vanes alter the normal amplitude distribution that a similar horn without vanes would produce. By avoiding the use of a solid physical boundary, in favor of zones of reduced pressure, more directivity can be achieved than would be expected were conventional approaches applied to solve the problem.

Figure 2:
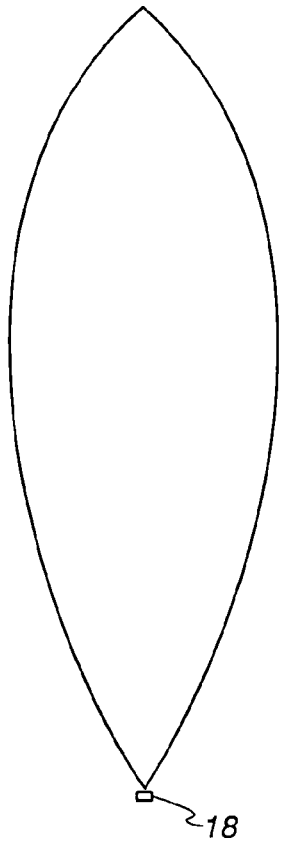
FIG. 2 is a schematic diagram of a radiation pattern for the first embodiment of a sound reproduction system illustrating certain aspects of the present invention.
Figure 3:
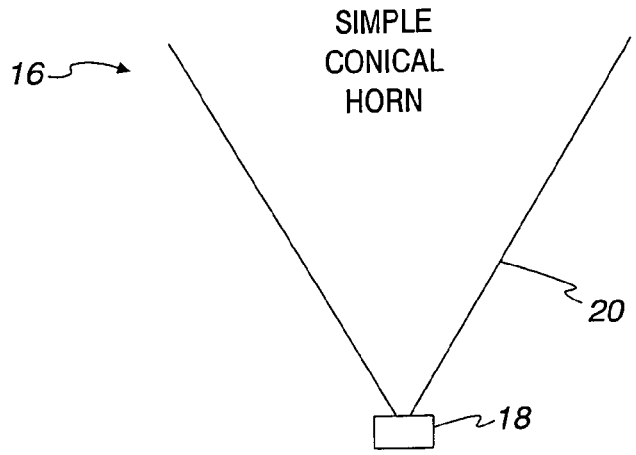
FIG. 3 is a diagrammatic representation of a second embodiment of a sound reproduction system illustrating certain aspects of the present invention.
Figure 4:
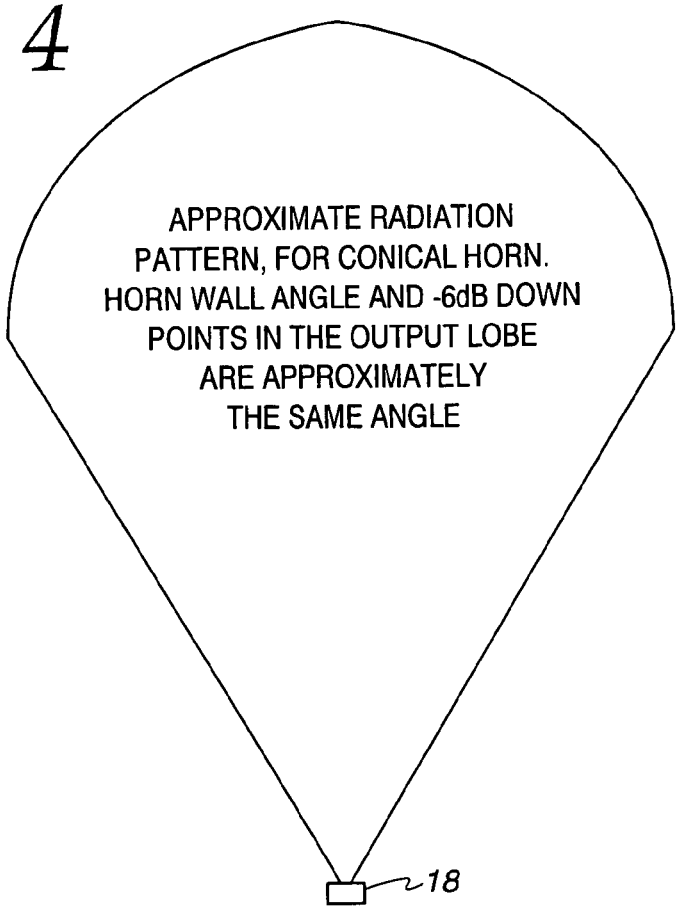
FIG. 4 is a schematic diagram of a radiation pattern for the second embodiment of a sound reproduction system illustrating certain aspects of the present invention.

Referring now to FIGS. 1-4, a simple conical horn system 16 shown in FIG. 3 has a radiation pattern as shown in FIG. 4. The horn system 16 includes a driver 18 and a simple conical horn enclosure or sound barrier 20 that presents an acoustical load to the driver output. FIG. 1 shows the horn system fitted with an appropriate shaded amplitude lens 26 to produce an improved sound system generally indicated at 30. The improved radiation pattern of system 30 is shown in FIG. 2, for comparison with the radiation pattern of the unimproved system 16 shown in FIG. 4. Notice that, with the present invention, the output, radiated energy is confined more to the central angle and less is present near the pattern edges.

Figure 5:
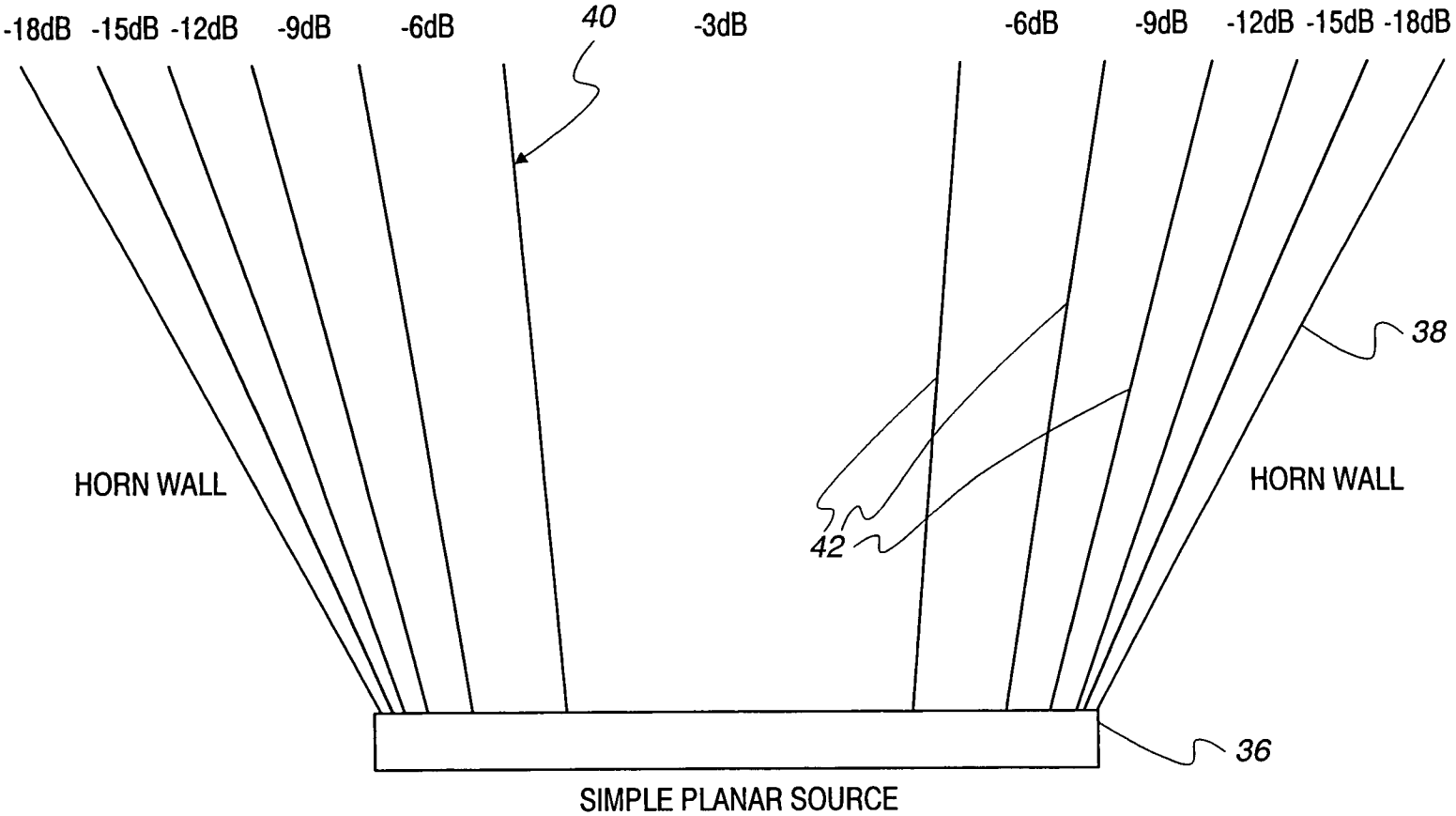
FIG. 5 is a diagrammatic representation of a third embodiment of a sound reproduction system illustrating certain aspects of the present invention.
Figure 6:
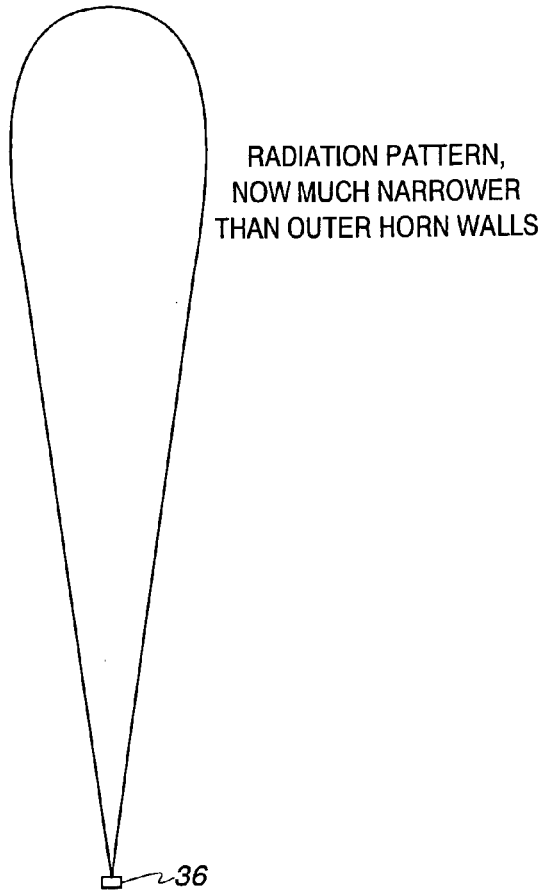
FIG. 6 is a schematic diagram of a radiation pattern for the third embodiment of a sound reproduction system illustrating certain aspects of the present invention.
Figure 7:
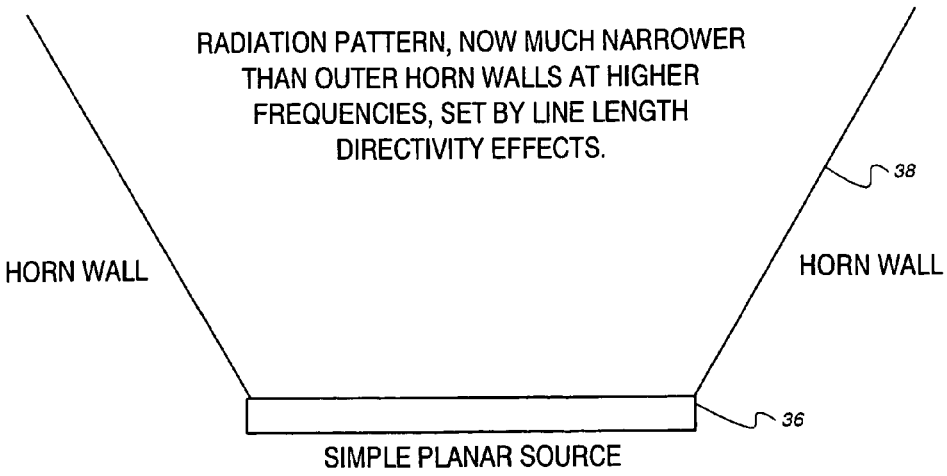
FIG. 7 is a diagrammatic representation of a component of a fourth embodiment of a sound reproduction system illustrating certain aspects of the present invention.

With reference to FIG. 7, alteration by the present invention of the radiation angle and amplitude is considered with reference to a planar source of sound, such as a ribbon speaker 36 or other source which is homogenous top to bottom, and that is attached to a simple conical horn 38. A source of this type would not normally be suitable for driving a horn in the length plane. However, by adding the shaded amplitude lens 40 of the present invention as shown in FIG. 5, one can alter the normal sized governed radiation angle over a wide frequency range into a more or less constant angle, very much unlike the source alone. The radiation pattern for the improved system of FIG. 5 is shown in FIG. 6. In addition, the sound energy can be focused or aimed within the outer horn wall angles. In this example, the source also has constant amplitude over its entire area, allowing the source to be broken up into sections, with the desired proportional power based on the fraction of the total area treated. For example, assuming it is desirable to confine half of the total energy into the center of coverage, the improved horn can be made to have a narrower pattern (in the normal direction), making it deeper and narrower, thereby also raising the frequency where pattern control is lost.

FIG. 5 shows lens 40 with its component vanes 42 added to define a custom radiation angle and amplitude distribution. In this example, the center section has vanes that are set at a + and −5 degrees relative to the center. In this case, each set of vanes are 5 degrees greater angle than before, until reaching the outer horn walls 38, drawn as a 60 degree horn. Note the length or area which is driven at the input end of each 5 degree section and that the next larger angle section has half the area at the driver and so gets driven with half the acoustic power. Here, the amplitude shading drops a fixed rate of 3 dB per 5 degrees.

The amplitude for each section is "shaded" or reduced by some ratio or other relationship, by adjusting the percentage of the total of each section by adjusting the area at the small end. From that, one sees that for one cell to be −3 dB from another, it has to have half the area (in the condition here where the source pressure is constant). It should be noted that neither a planar or a constant amplitude source are required to practice the present invention, but these types of drivers make the design and explanation easier.

While losses of 3 dB (a factor of two) are mentioned in the course of describing the present invention, the reduction in amplitude for adjacent cells has been as large as 6 dB in some prototypes constructed according to principles of the present invention, and as small as 1 dB in others. In each case, the amplitude is distributed by the ratio of areas at the small end of the vanes.

Figure 8:
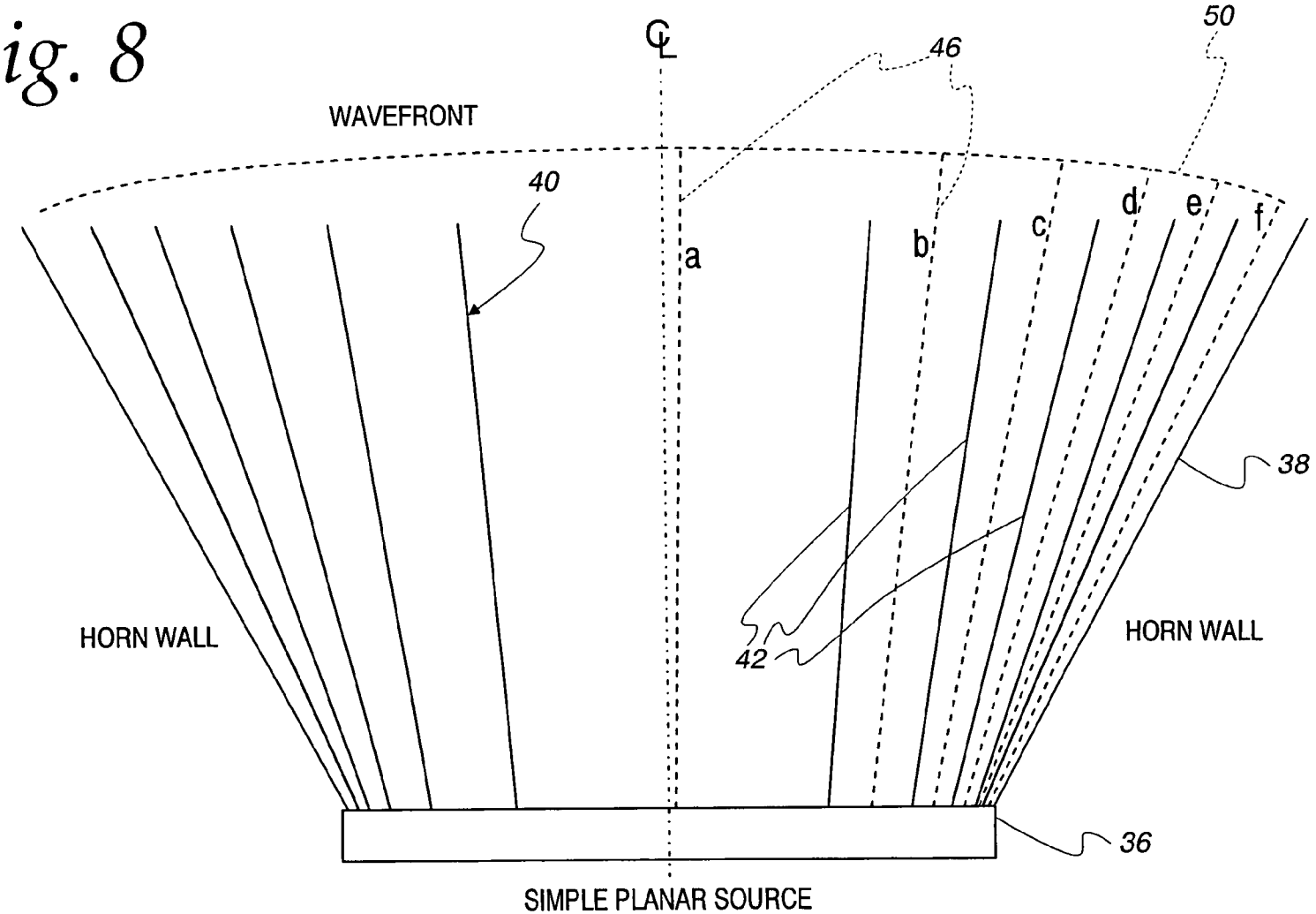
FIG. 8 is a diagrammatic representation of the fourth embodiment of a sound reproduction system illustrating certain aspects of the present invention.

While the division of the amplitudes can be accomplished by the area shading, the effect of the lens is that of altering the progress of the wavefront by the physical path lengths being different at different locations. FIG. 8 shows the improved system of FIG. 5, from the standpoint of the wavefront or time. Dotted reference lines 46, labeled a-f, show several identical length paths and the dashed reference line 50 is the custom wavefront shape that results.

Notice that, due to its large acoustic size, the flat planar line source 36 would normally have very narrow, length-governed radiation angle in this plane. With the introduction of the shaded amplitude lens, the total radiation angle is expanded to 60 degrees with approximately half the energy concentrated into a 10 degree angle. As demonstrated here, the shaded amplitude lens can both alter the wavefront shape for directivity purposes and alter the distribution of energy within the horn outer wall angle.

Using the present invention, for example, one could also construct a lens for a source that is acoustically large in both planes like an acoustically large, flat piston. In the examples illustrated herein, however, the horn walls in the horizontal plane define the radiation angle.

The present invention allows one to address the inverse square law problem by directing an increasing portion of the total energy to the most distant locations, to partly or fully compensate for falloff according to the inverse square law. With the present invention, the different distances from the source to the audience members and the inverse square law is taken into account.

Figure 9:
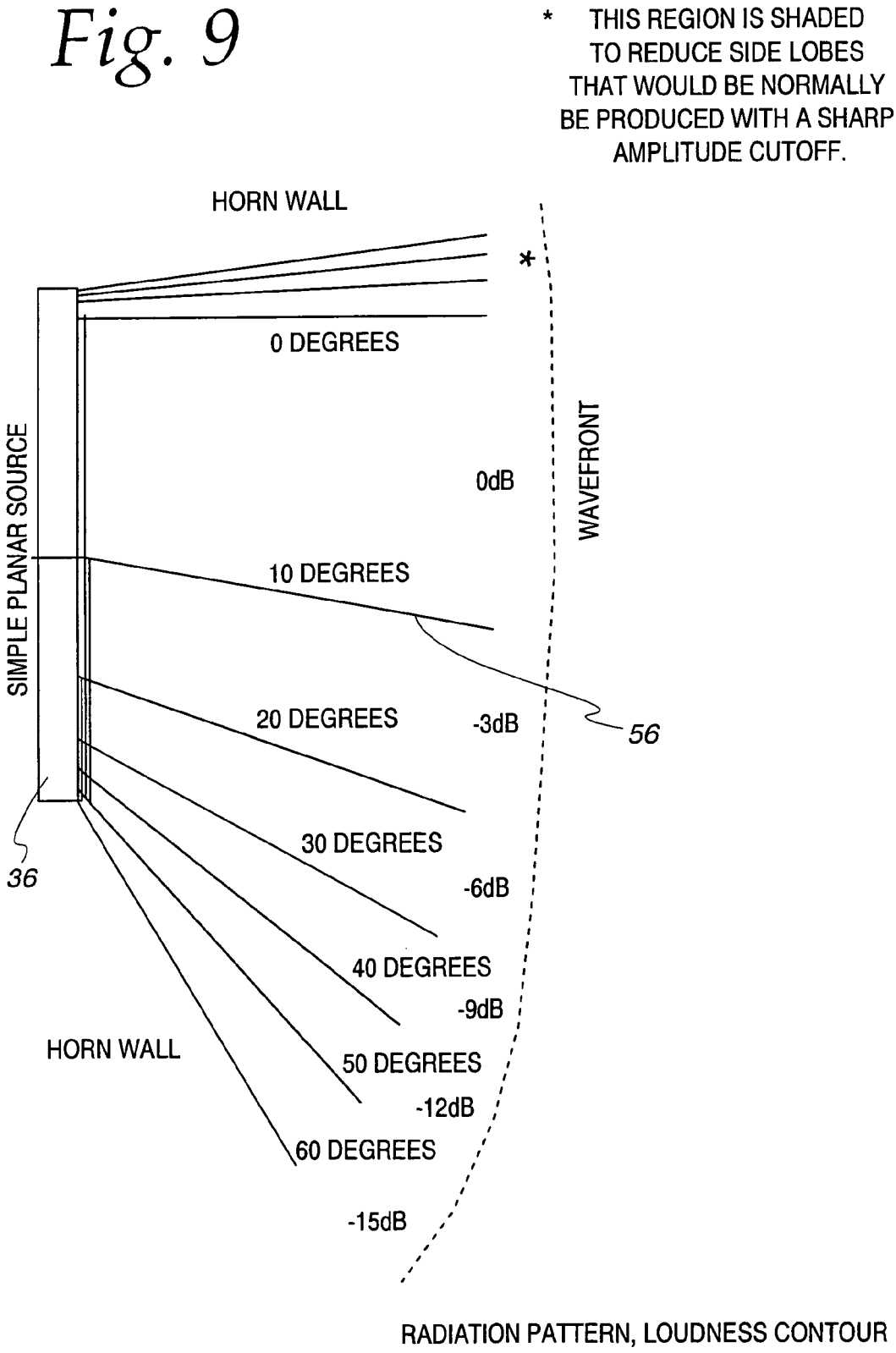
FIG. 9 is a diagrammatic representation of a fifth embodiment of a sound reproduction system illustrating certain aspects of the present invention.

While the foregoing examples employ systems that are symmetric about the center line, the present invention may also be employed to produce an asymmetric lens for use in asymmetric systems. Referring now to FIG. 9 an asymmetric distribution lens 56 on the planar source 36. Notice that half of the energy is confined from zero degrees to 10 degrees down angle and then each 10 degree angle section is −3 dB or half the area. If desired, −6 dB steps could be employed instead, with each step one fourth the area. A −10 dB step would be one tenth, a −12 dB step would be one sixteenth, and a −20 dB step would be one one-hundredth and so on. It should be noted that the amplitude shading produces a highly asymmetric radiation pattern. This source can be substituted for source 10 in FIG. 16 to provide a constant loudness contour radiation pattern from an appropriate shaded amplitude lens. Notice that one side of the radiation pattern can be tailored to offset the inverse square law to the audience. In this drawing, essentially everyone would be hearing the same loudness and because it is a point source, the frequency response is essentially the same at each seat.

Figure 10:
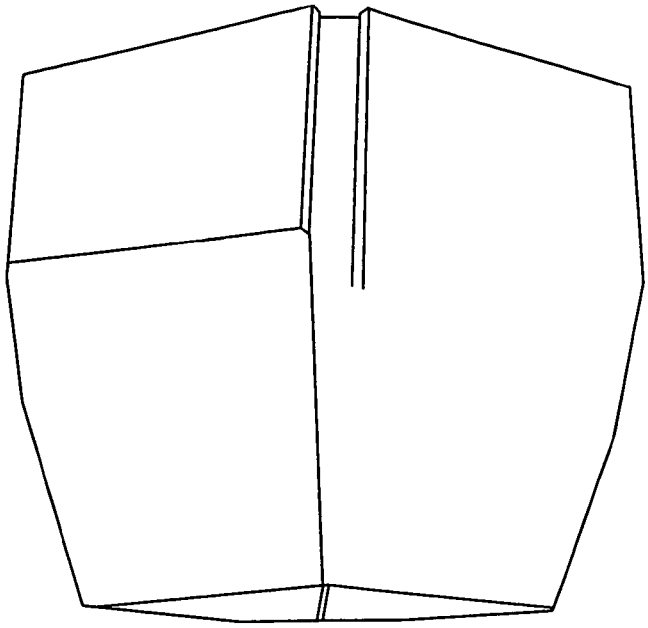
FIG. 10 is a perspective view of a flying sound reproduction system illustrating certain aspects of the present invention.
Figure 11:
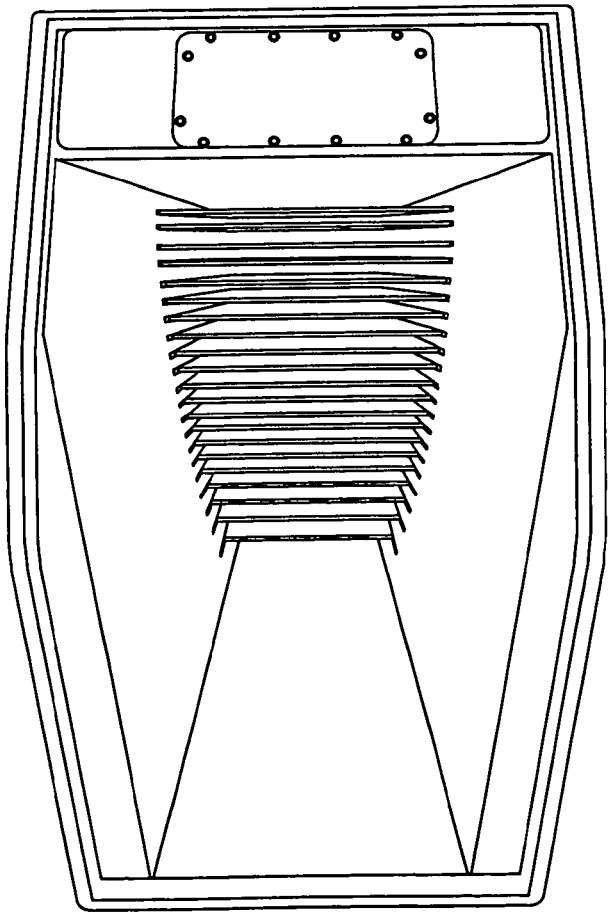
FIG. 11 is a perspective view showing interior details of the flying sound reproduction system illustrating certain aspects of the present invention.
Figure 12:
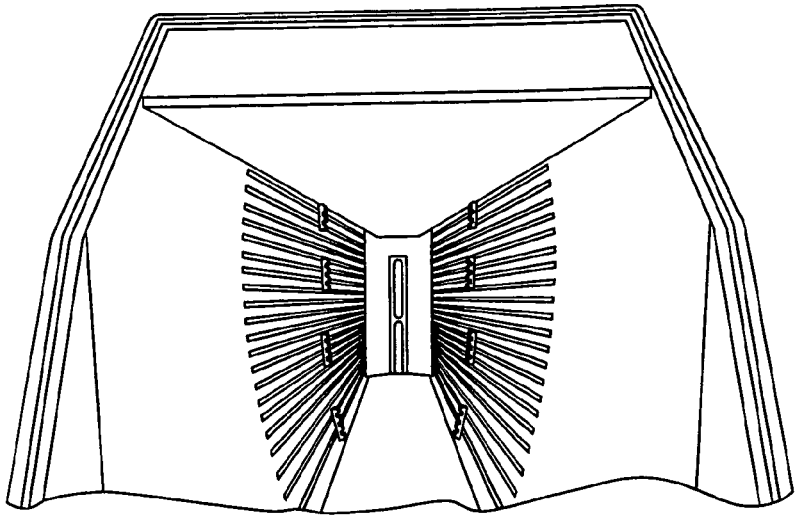
FIG. 12 is a perspective view showing further interior details of the flying sound reproduction system illustrating certain aspects of the present invention.
Figure 13:
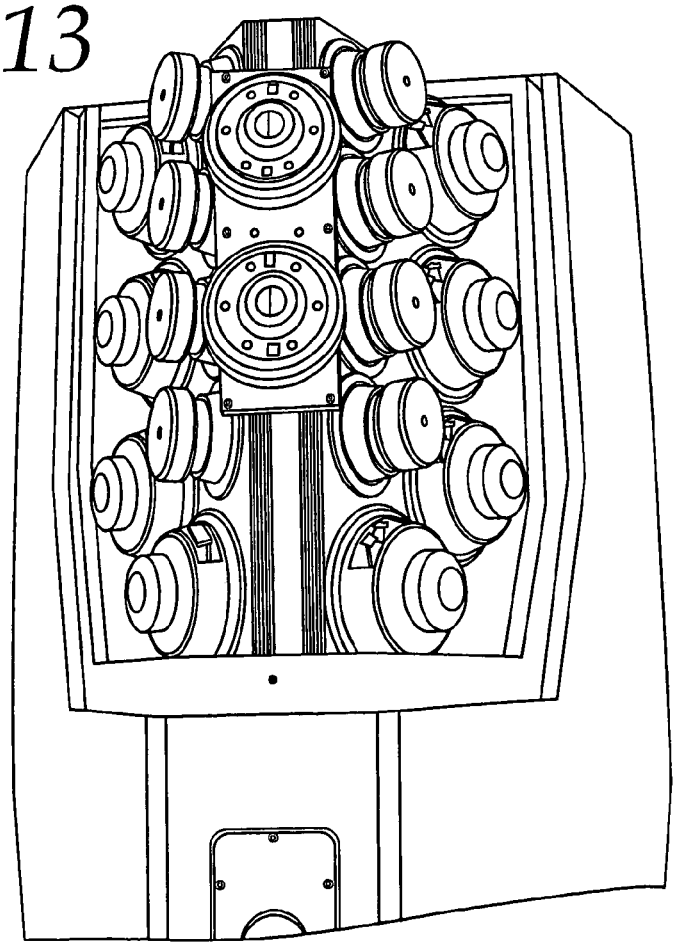
FIG. 13 is a rear perspective view showing drivers employed with the flying sound reproduction system illustrating certain aspects of the present invention.
Figure 17A:
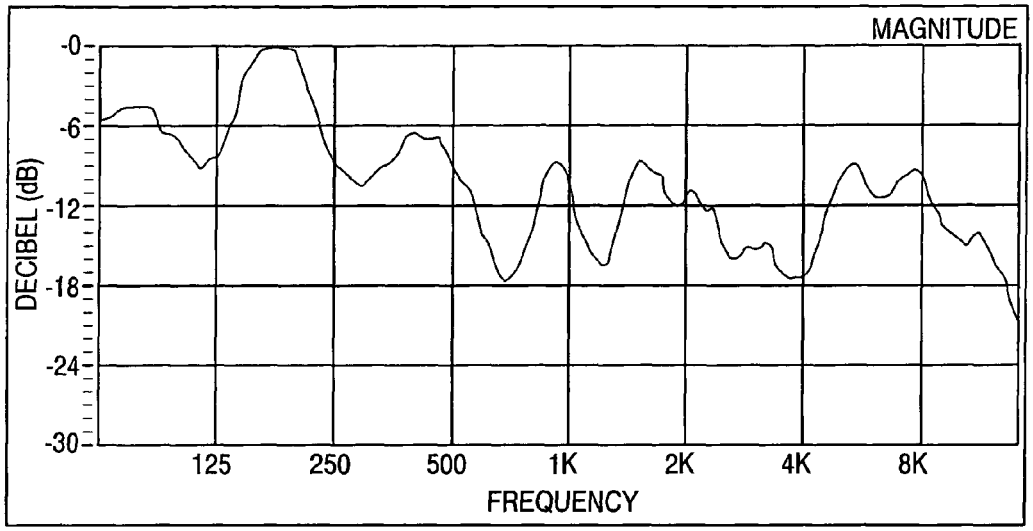
FIGS. 17*a*-17*o* are schematic diagrams showing performance of a sound reproduction array according to the present invention, taken at different distances from the system.
Figure 17B:
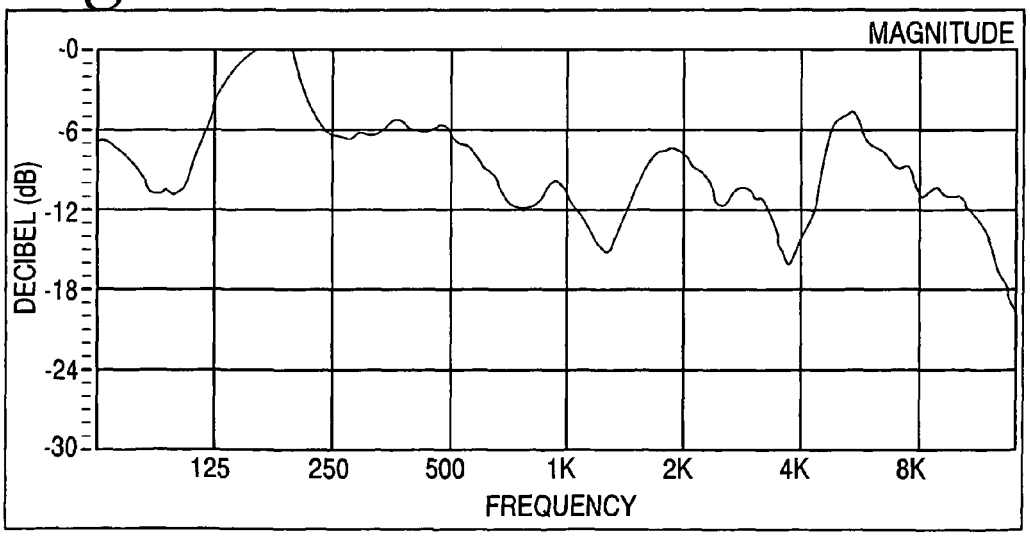
Figure 17C:
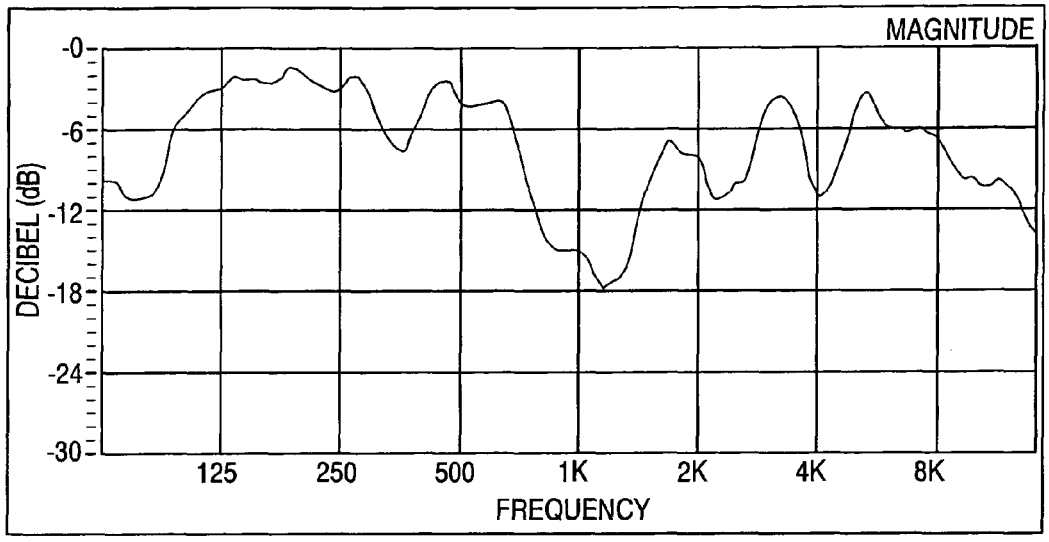
Figure 17D:
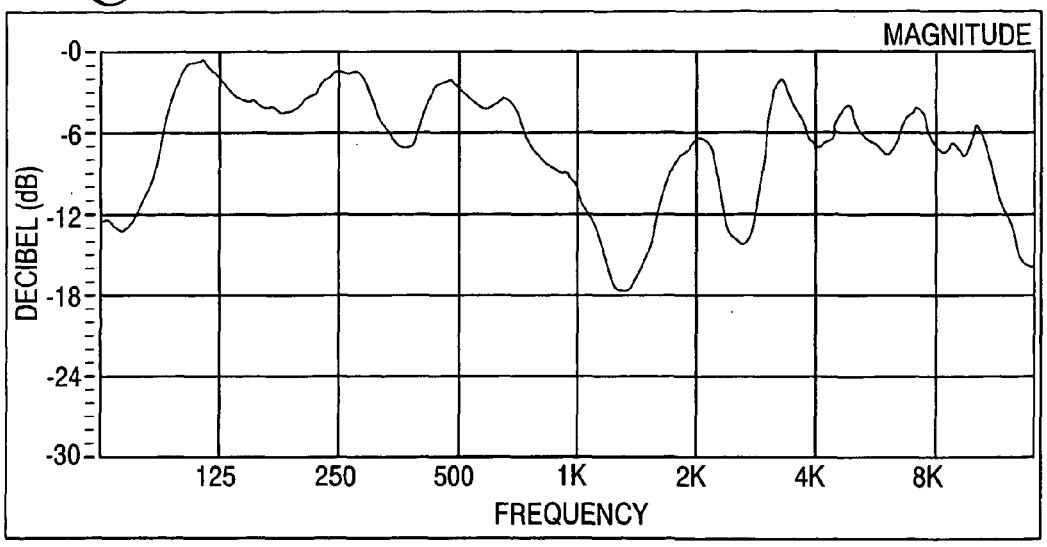
Figure 17E:
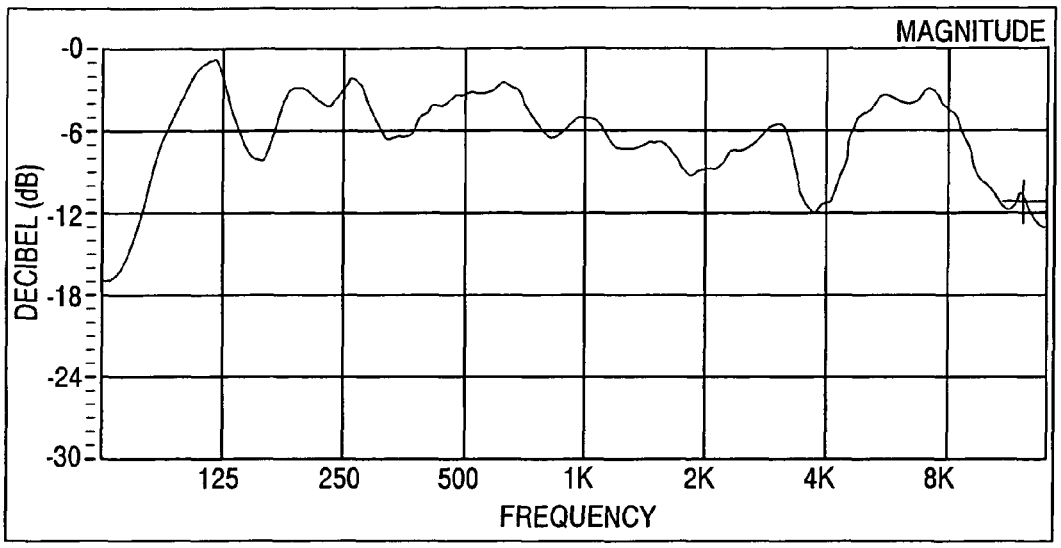
Figure 17F:
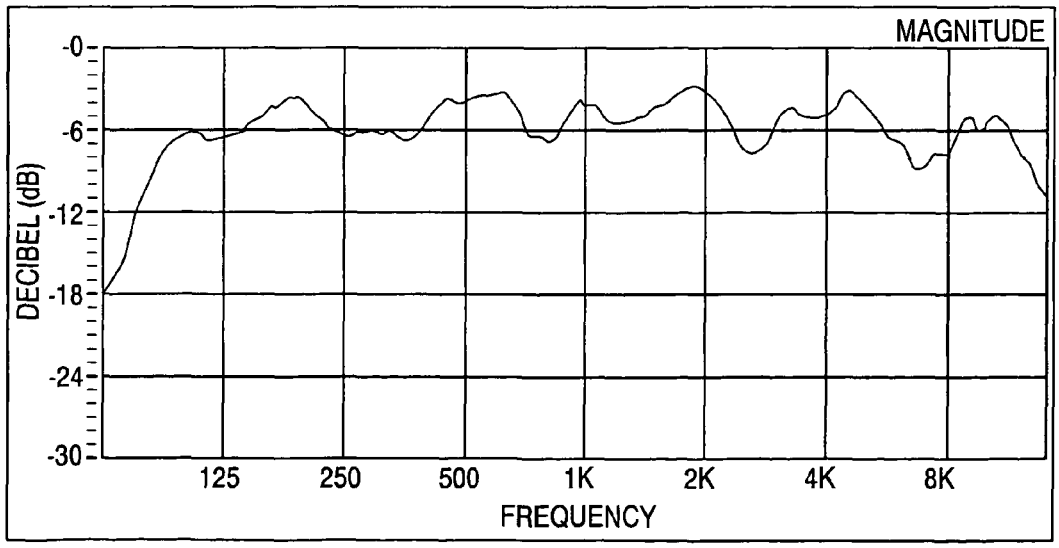
Figure 17G:
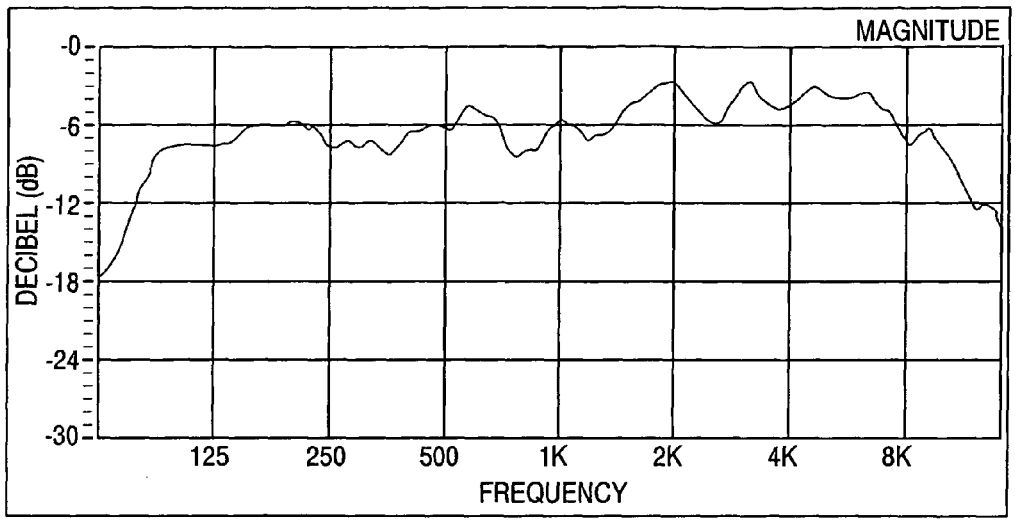
Figure 17H:
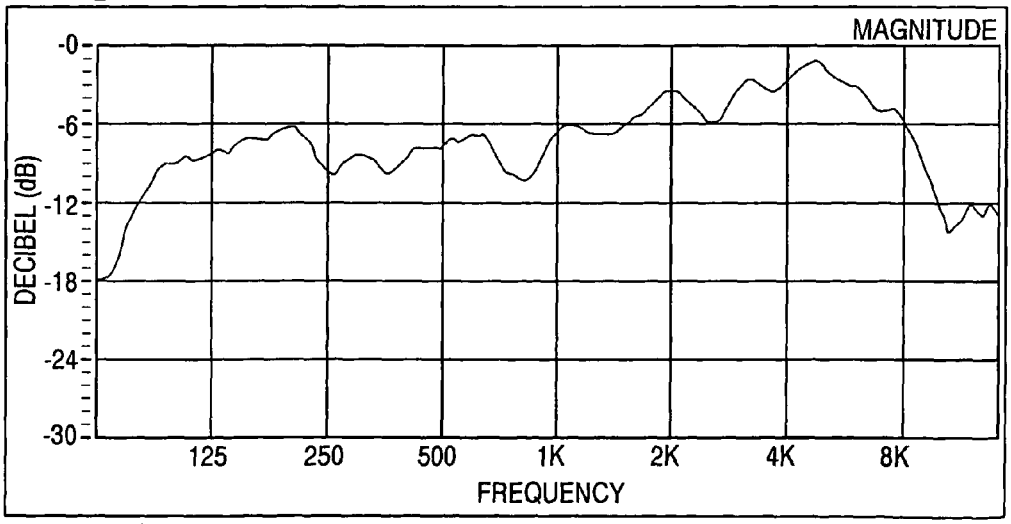
Figure 17I:
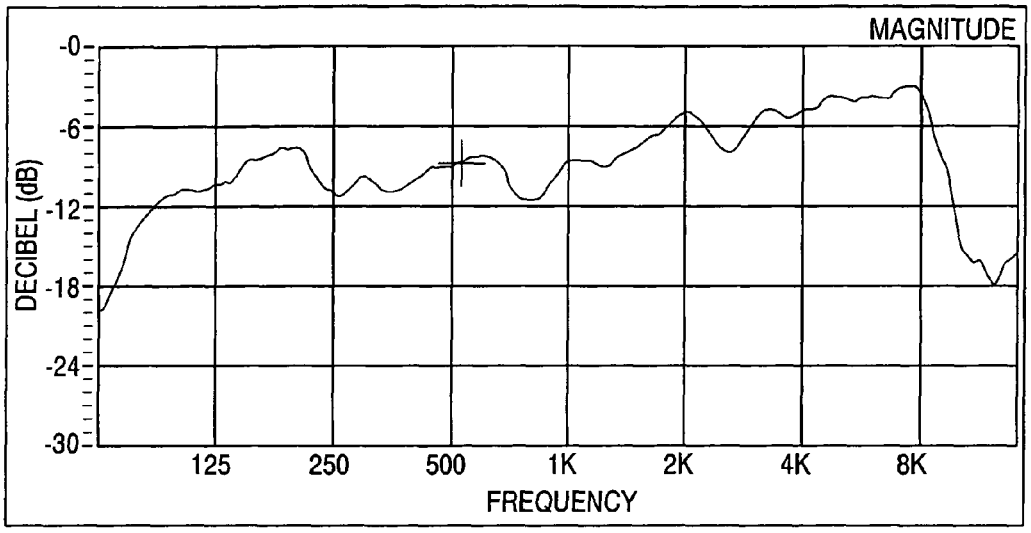
Figure 17J:
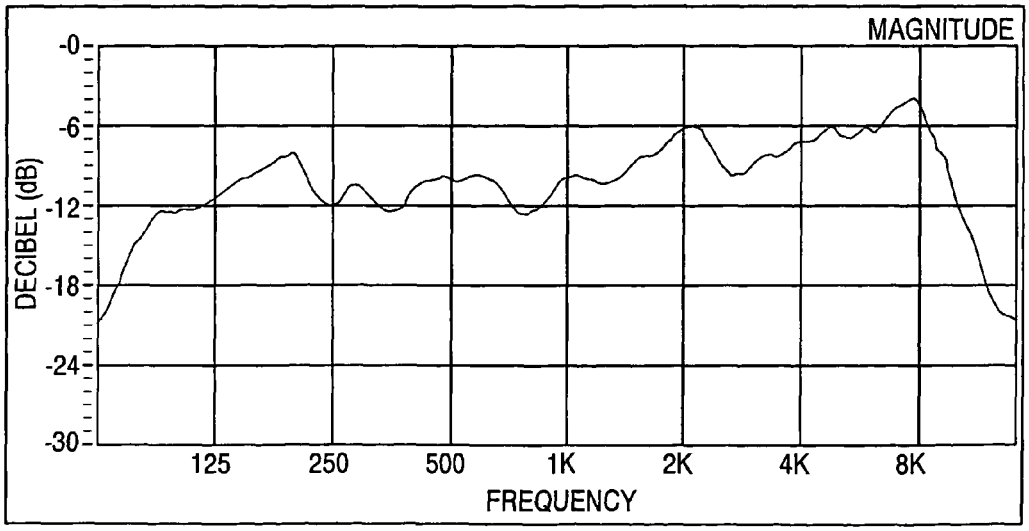
Figure 17K:
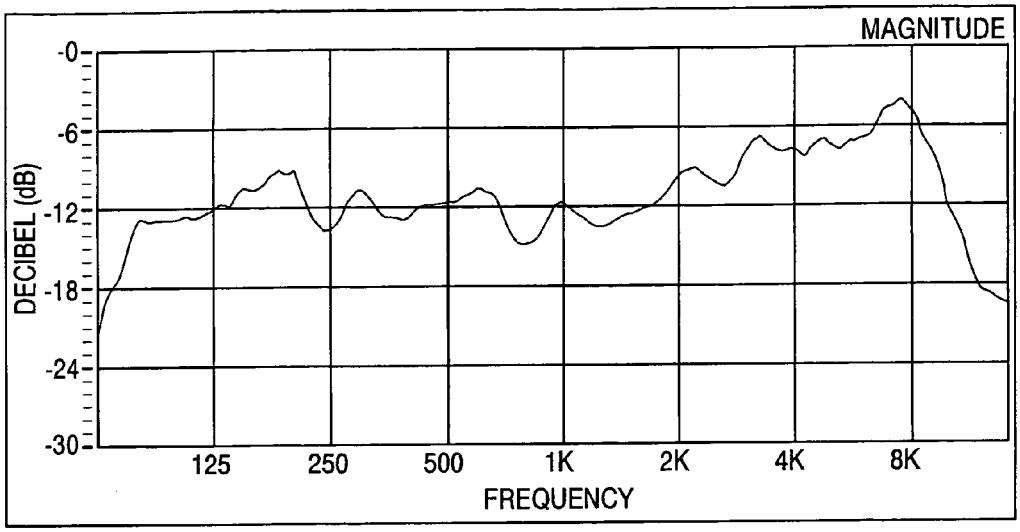
Figure 17L:
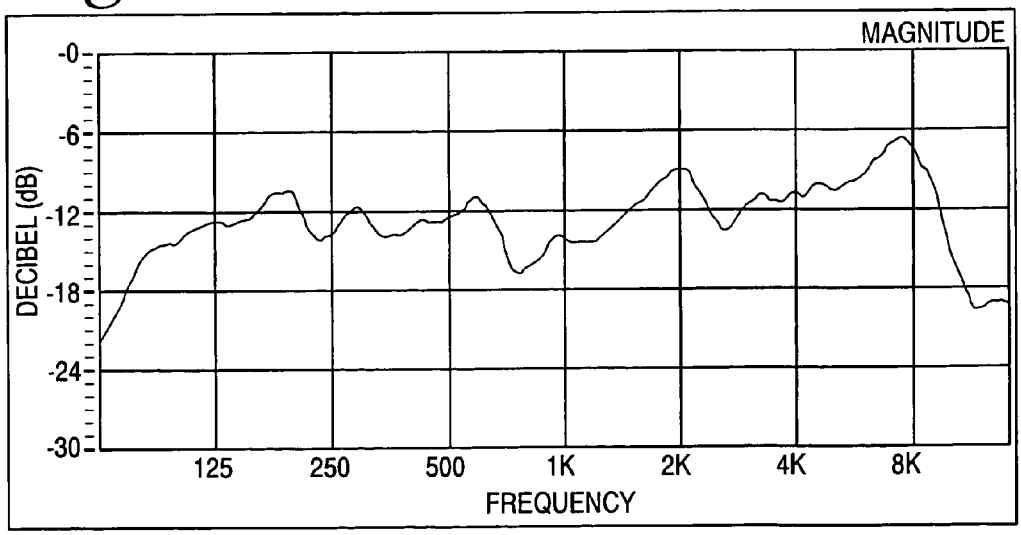
Figure 17M:
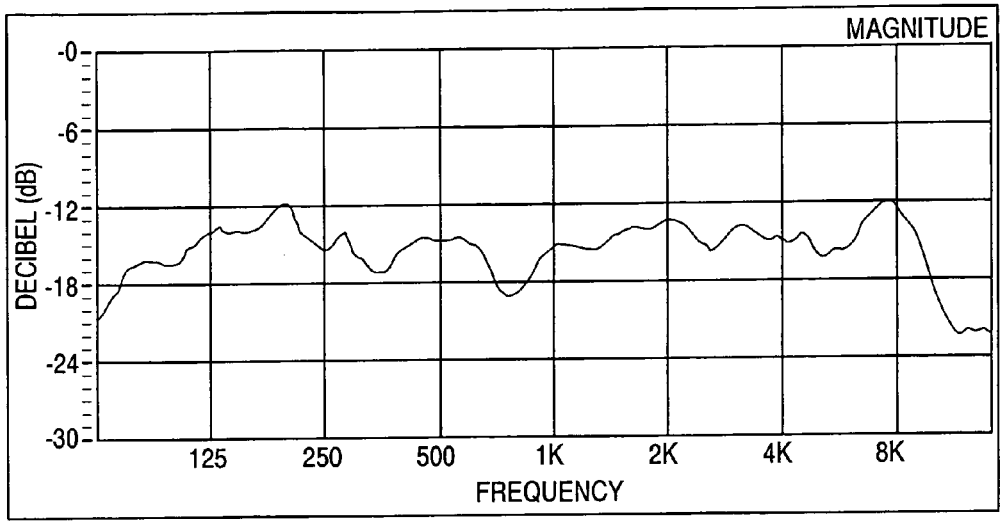
Figure 17N:
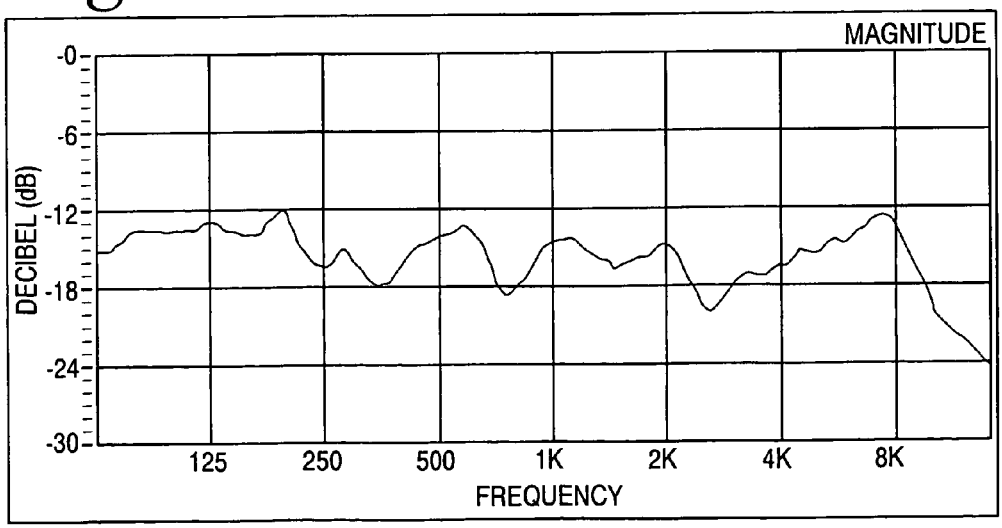
Figure 17O:
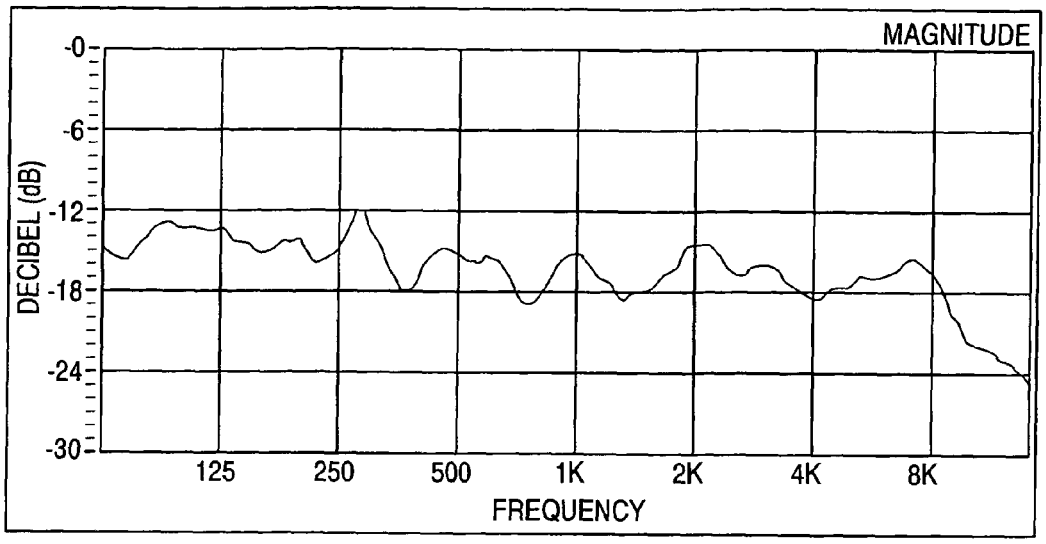
Figure 18A:
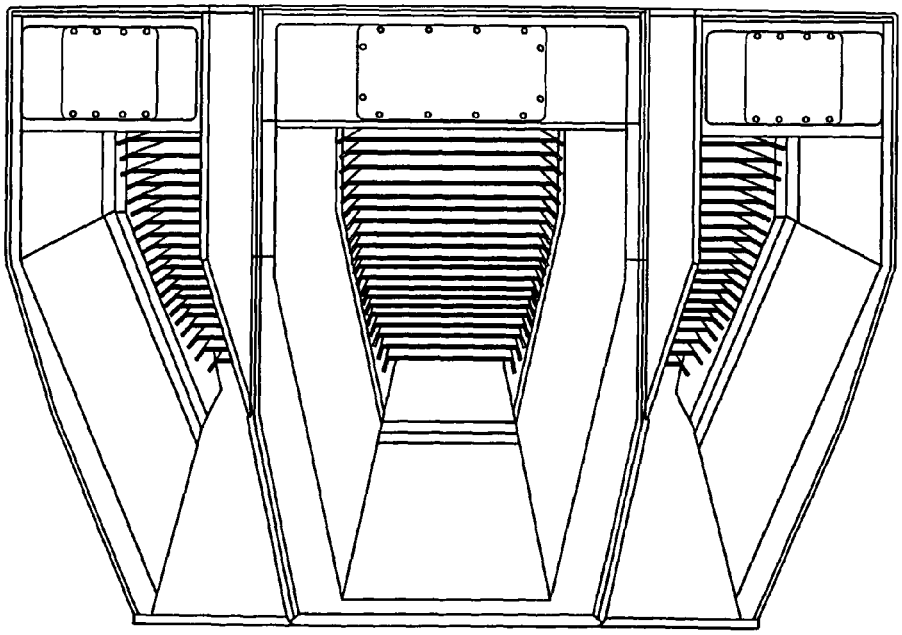
FIGS. 18*a*-18*g* show the sound reproduction array in greater detail.
Figure 18B:
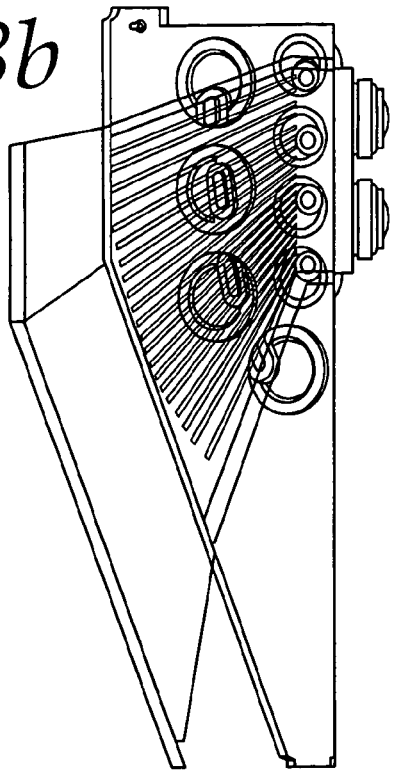
Figure 18C:
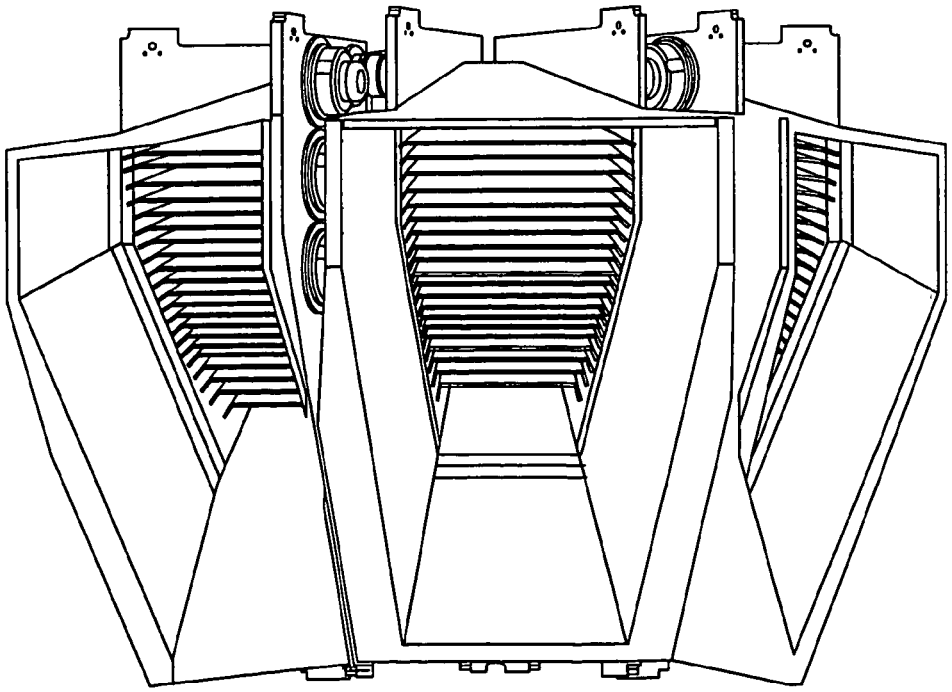
Figure 18D:
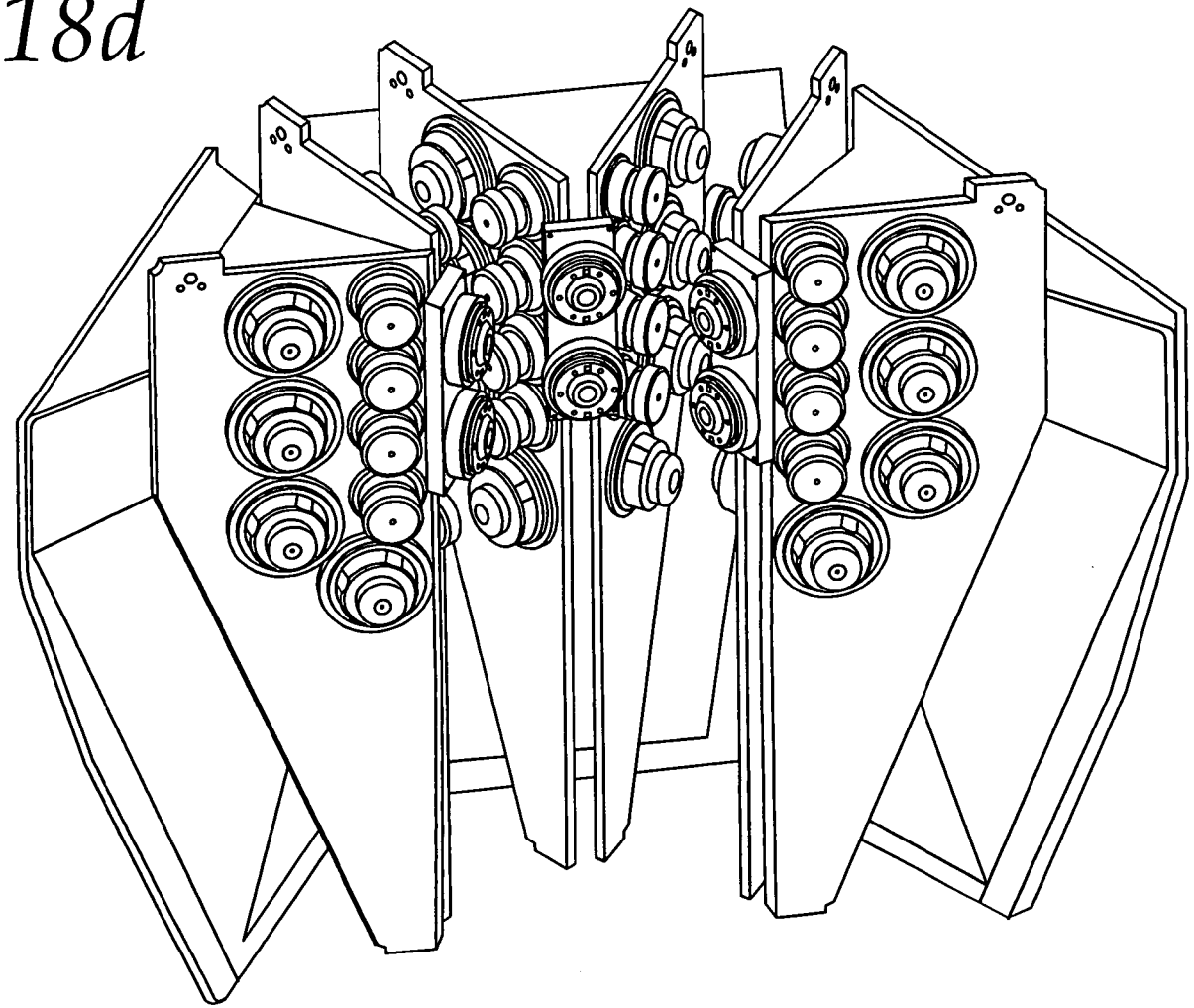
Figure 18E:
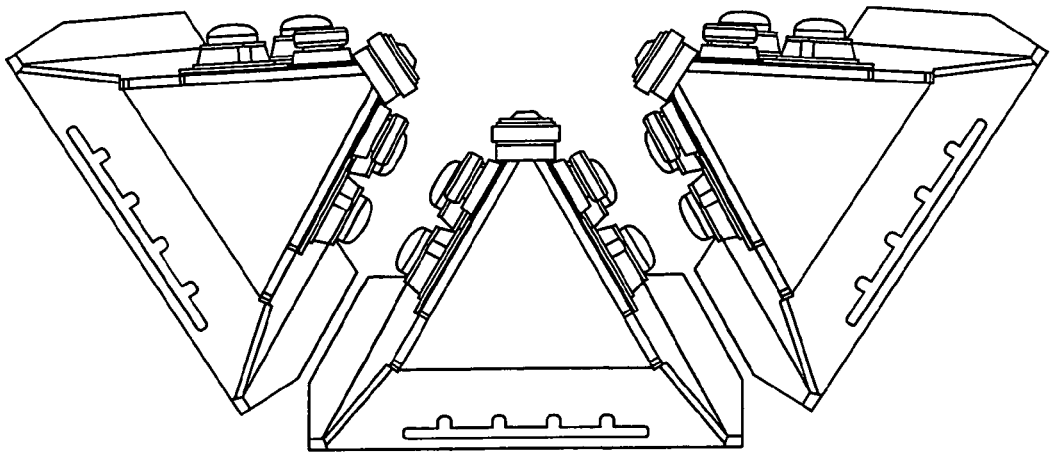
Figure 18F:
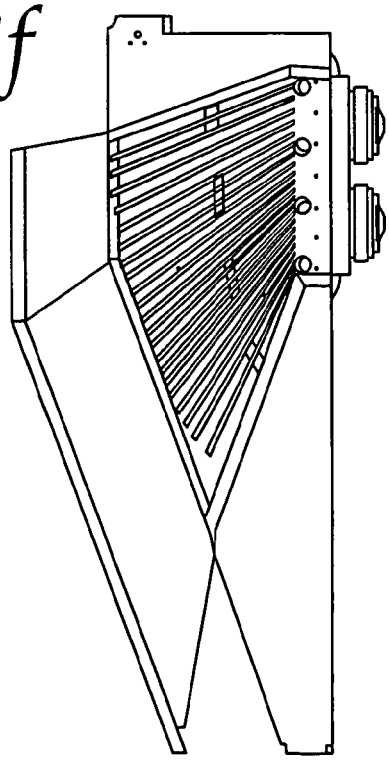
Figure 18G:
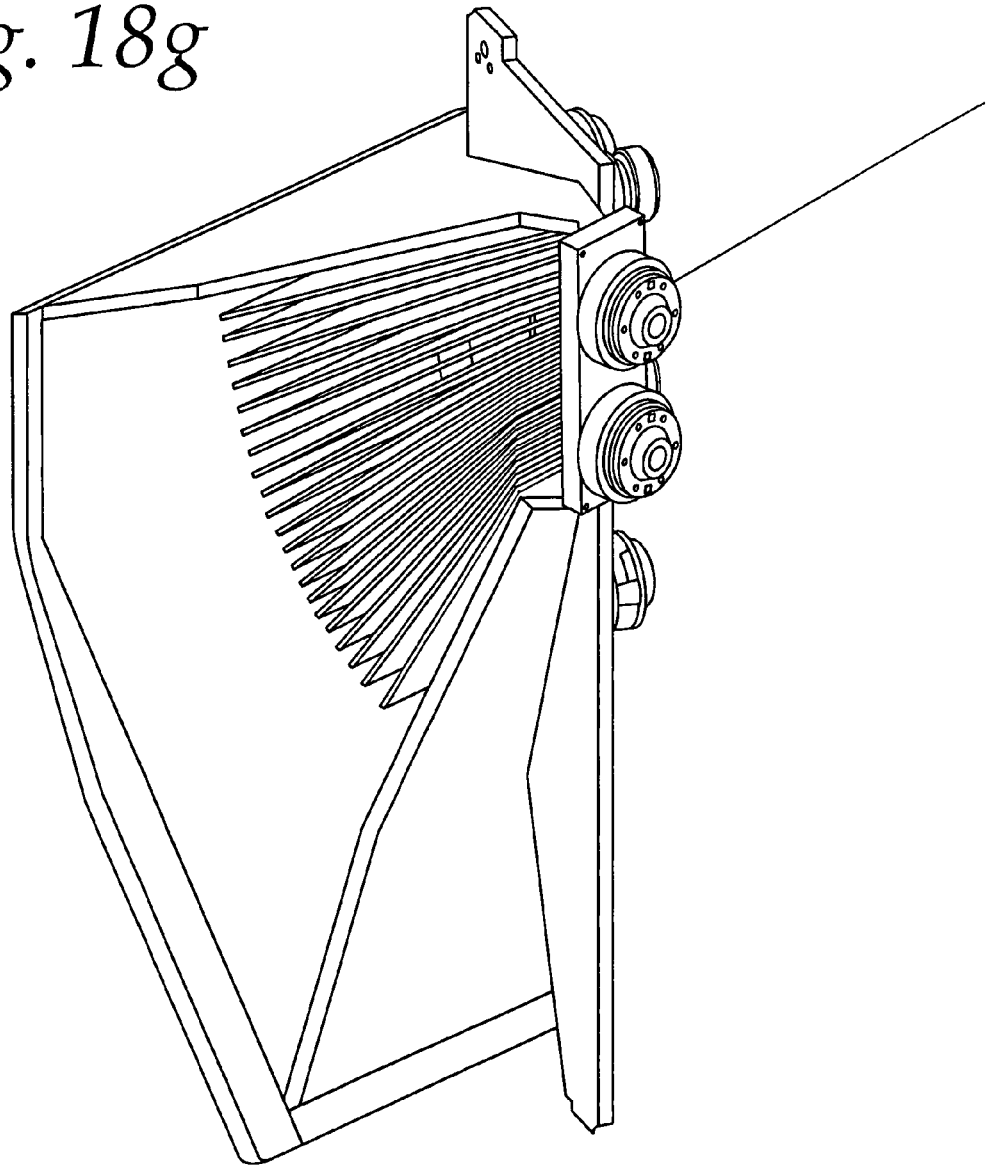

FIG. 10 shows a product in which two improved systems are located side by side. FIG. 11 shows a close up view of one of the improved systems, and FIG. 12 shows the same improved system, looking into the horn with the vanes removed for clarity of illustration. FIG. 13 shows the rear of the improved system, exposing an arrangement of drivers. The mid range drivers are coupled into the section before the vanes begin and the low frequency (longer wave length) driver pressure is added through holes into the vane cells. FIGS. 18*a*-18*g* show a flying sound reproduction system employing three of the systems of FIGS. 10-13. FIG. 18*a* shows a front view with three speaker enclosures arranged in a triangular array as can be seen in the top plan view of FIG. 18*e*. FIG. 18*b* is a cross-sectional view taken along a vertical mid-section of FIG. 18*a*. FIG. 18*c* shows a front view of the array with the outer shell removed. FIG. 18*d* shows a rear elevational view of the array. The top plan view of FIG. 18*e* shows three of the enclosures arrayed to cover an audience from an elevated or flying position. FIG. 18*f* is a vertical cross-section of the array. FIG. 18*g* is a perspective view of one of the enclosures, shown partly broken away, so as to expose the vanes disposed within the enclosure. FIGS. 17*a*-17*o* show measured performance of loudness and frequency response of the array, taken at a number of different distances. Notice how the spectrum and amplitude change very little over the large range of distances at which measurements were taken.

A brief discussion of governing conditions related to the present invention will now be considered. A horn directing a source's radiation pattern is an example of sound propagating in a duct in an acoustically large condition. Here, directivity is controlled by the horn passageway which is normally larger across than the wavelength being produced. On the other hand, when sound is traveling in an acoustically small condition (through a duct which is very small compared to the wavelength), it has no directivity and is able to go around corners without a problem like a simple pressure system.

Figure 14:
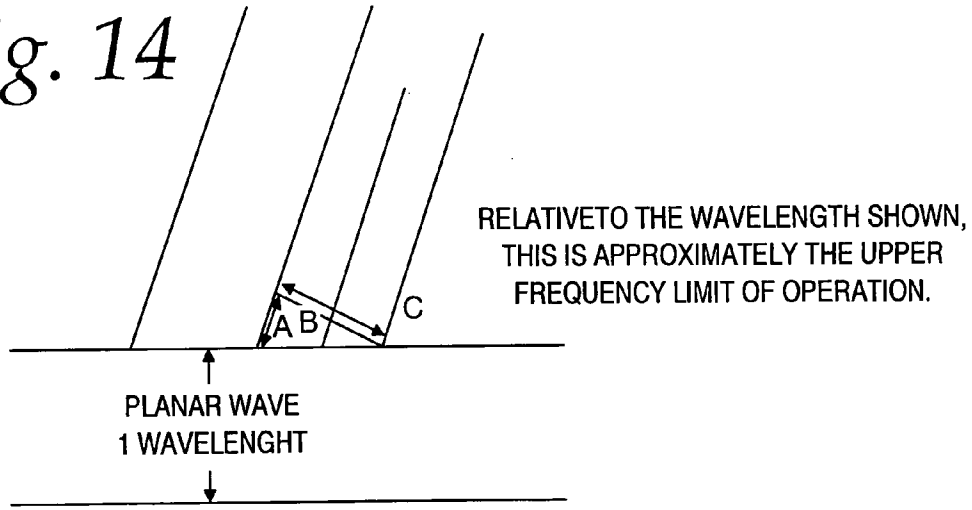
FIGS. 14 and 15 are schematic diagrams illustrating design features addressing certain aspects of the present invention.
Figure 15:
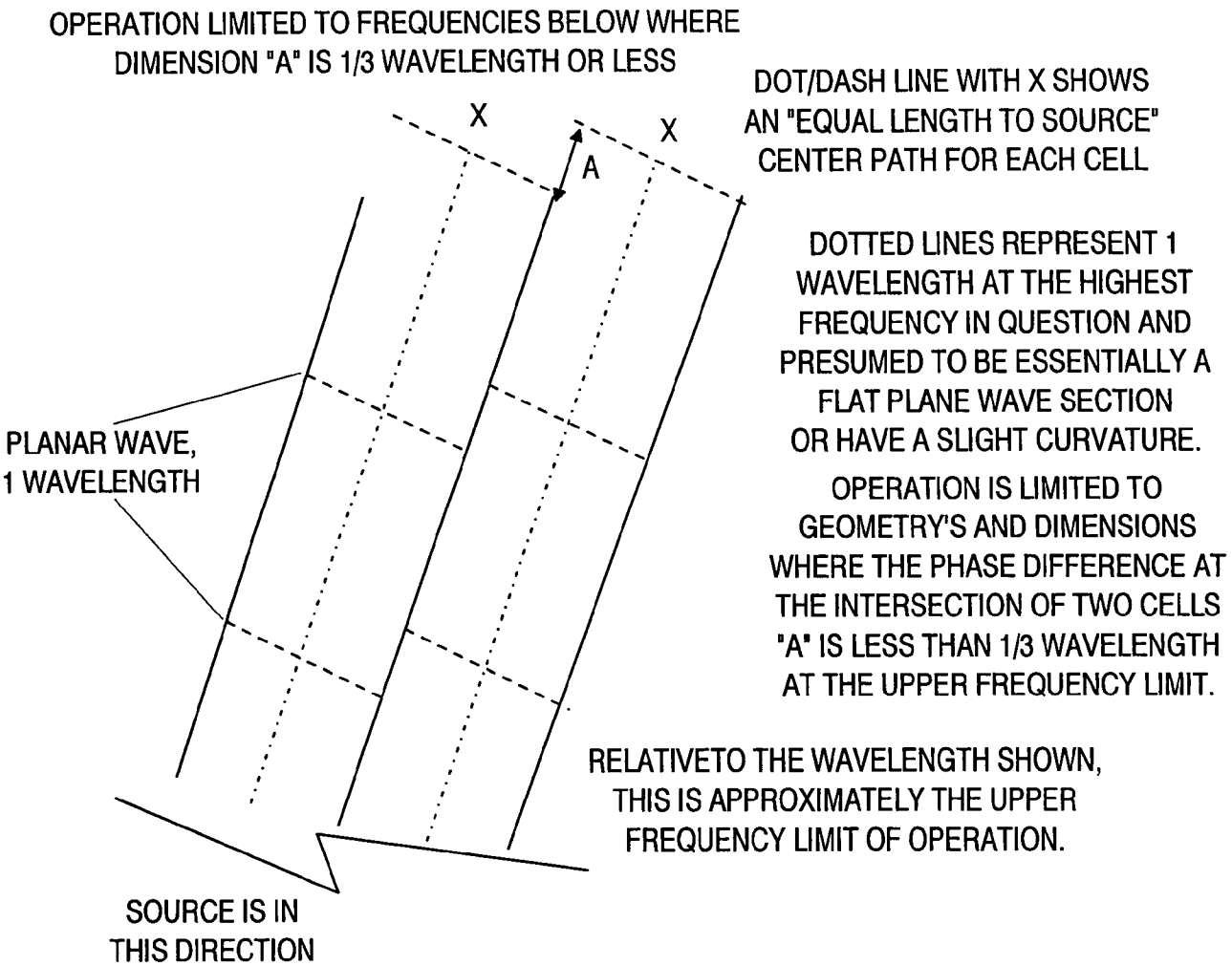

With the shaded amplitude lens there are two similar rules of thumb. The angle of the vane requires that the sound bend to accommodate a new angle. An important condition that should be observed, allows the sound to actually bend as desired. This condition defines the frequency point below which the passage way dimensions and bend angle have essentially no adverse effect. This would apply to conventional parallel plate lenses. FIG. 14 shows a planar wavefront entering one cell of a lens. In order for the wavefront to change direction and propagate perpendicular to the centerline, the difference in path lengths "A" where the angle changes must be less than ⅓ wavelength at the highest frequency of interest. Dimensions greater than that allow internal cancellation and ripples in the response as well as the possibility of propagating higher order modes (sound bouncing from wall to wall within a cell). FIG. 15 shows the exits of two adjacent cells where a second acoustic size rule should be followed. The difference between two adjacent cells where the radiations join can be no more than ⅓ wavelength as shown, at the highest frequency of interest.

The foregoing description and the accompanying drawings are illustrative of the present invention. Still other variations in arrangements of parts are possible without departing from the spirit and scope of this invention.

I claim:

1. A system for reproducing sound, comprising:

at least one driver;

a horn member in acoustic loading relationship to the driver;

the horn member defining an internal passageway having a first end and a second open end, with the at least one driver at the first end, producing a driver soundwave having an initial central axis and an initial amplitude distribution; and a plurality of substantially planar vanes disposed in the internal passageway, disposed across the internal passageway at different angles from the central axis and deflecting respective portions of the driver soundwave along several substantially identical length sound paths so as to alter the initial amplitude distribution.

2. The system in accordance with claim 1 wherein adjacent vanes are spaced from one another and situated at five-degree increments relative to the center axis.

* * * * *